US009718118B2

(12) United States Patent
McBain

(10) Patent No.: US 9,718,118 B2
(45) Date of Patent: Aug. 1, 2017

(54) FORGING APPARATUS

(71) Applicant: ROLLS-ROYCE PLC, London (GB)

(72) Inventor: John McBain, Glasgow (GB)

(73) Assignee: ROLLS-ROYCE plc, London (GB)

( * ) Notice: Subject to any disclaimer, the term of this patent is extended or adjusted under 35 U.S.C. 154(b) by 285 days.

(21) Appl. No.: 14/577,430

(22) Filed: Dec. 19, 2014

(65) Prior Publication Data

US 2015/0190855 A1 Jul. 9, 2015

(30) Foreign Application Priority Data

Jan. 9, 2014 (GB) ..... 1400318.0

(51) Int. Cl.

| | |
|---|---|
| ***B21K 3/04*** | (2006.01) |
| ***B21J 9/02*** | (2006.01) |
| ***B21J 5/02*** | (2006.01) |
| ***B21K 3/00*** | (2006.01) |
| ***B21C 23/18*** | (2006.01) |

(52) U.S. Cl.

CPC ..... *B21K 3/00* (2013.01); *B21C 23/183* (2013.01); *B21J 5/025* (2013.01); *B21J 9/027* (2013.01); *B21K 3/04* (2013.01)

(58) Field of Classification Search

CPC ..... B21C 23/18; B21C 23/183; B21C 23/218; B21C 26/00; B21J 1/04; B21J 13/02; B21J 5/02; B21J 5/025; B21J 5/06; B21J 9/027; B21K 3/00; B21K 3/04

See application file for complete search history.

(56) References Cited

U.S. PATENT DOCUMENTS 2,663,205 A * 12/1953 Allen ..... B21J 5/02 72/344
3,691,804 A * 9/1972 Clendenin ..... B21J 5/02 72/267
4,055,975 A * 11/1977 Serfozo ..... B21J 5/02 29/DIG. 45
5,249,450 A 10/1993 Wood et al.
(Continued)

FOREIGN PATENT DOCUMENTS

EP 2 444 170 A1 4/2012
EP 2 745 953 A1 6/2014
(Continued)

OTHER PUBLICATIONS

Jul. 31, 2014 Search Report issued in British Application No. GB 1400318.

*Primary Examiner* — R. K. Arundale
*Assistant Examiner* — Pradeep C Battula
(74) *Attorney, Agent, or Firm* — Oliff PLC

(57) ABSTRACT

A forging apparatus and method is disclosed in which an extrusion punch is held between an upper press and a lower press and propelled towards a billet by a ram to form an extruded shaped component. The extrusion punch has a striking face in which a recess is formed. During the extrusion process, material from the billet enters the recess so as to lock the extrusion punch and the shaped component together. Accordingly the shaped component is not lifted up with the upper press when it is separated from the lower press and so the position of the shaped component after the forging extrusion operation is known accurately and reliably.

3 Claims, 4 Drawing Sheets

(56) References Cited

U.S. PATENT DOCUMENTS

| | | | | |
|---|---|---|---|---|
| 6,678,574 | B2 * | 1/2004 | Fujii | B21J 5/02 29/897.2 |
| 6,735,996 | B2 * | 5/2004 | Heussen | B21J 5/08 72/355.6 |
| 2012/0100385 | A1 * | 4/2012 | Takemura | B21J 1/04 428/577 |
| 2014/0165688 | A1 * | 6/2014 | McBain | B21J 5/025 72/352 |

FOREIGN PATENT DOCUMENTS

| | | |
|---|---|---|
| GB | 1076154 | 7/1967 |
| JP | A-2000-343171 | 12/2000 |
| JP | 2011152548 A * | 8/2011 |

* cited by examiner

FORGING APPARATUS

CROSS-REFERENCE TO RELATED APPLICATIONS

This application is based upon and claims the benefit of priority from British Patent Application Number 1400318.0 filed 9 Jan. 2014, the entire contents of which are incorporated by reference.

BACKGROUND

1. Field of the Disclosure

This disclosure relates to an apparatus and method for forging/extruding a shaped component, for example a shaped component of a gas turbine engine. At least part of the disclosure relates to a method and apparatus for use in automated forging/extruding of a shaped component.

2. Description of the Related Art

Forging is used in a variety of metalworking operations in order to produce shaped components. Typically, a hammer or ram is used to provide a compressive force to a billet of metal (which may be heated) in order to deform the metal into the shape of a die.

Various different types of forging process have been developed to suit the desired properties of the shaped component, for example in terms of size, shape, material properties and required throughput.

In one particular type of forging, which may be referred to as a horizontal split die forging press or as a multiforge, a billet of heated metal is positioned in a forging press, and then a ram is used to strike the billet so as to provide a, typically horizontal, force to press the metal billet into a die. In this way, the shape of the billet deforms so as to take on the shape of the die. Such an arrangement may be suitable for automation, for example using an reciprocating ram and an automated machine for positioning the billet and removing the shaped part from the die.

An example of a forging apparatus 100 is shown in FIG. 1. The forging apparatus 100 comprises an upper press 110 and a lower press 120. In operation, the upper press 110 and the lower press 120 move together and are held together by a grip load, which may be on the order of hundreds of tonnes. A die piece 130 is positioned between the upper press 110 and lower press 120. The die piece 130 holds a billet of metal 150 when the presses 110, 120 are moved together under the grip load.

In the forging operation, a punch 140 is propelled towards the billet 150 in a direction shown by arrow A in FIG. 1. The punch 140 comprises a ram portion 144 and a striking portion 142. The striking portion 142 strikes the billet 150, which may be pre-heated, and forces the metal in the billet 150 to move in the general direction of arrow A into a shaped die 132, which is a part of the die piece 130. In this way, the shape of the billet 150 changes to correspond to the shape of the shaped portion 132.

FIG. 2 shows a cross section through a part of the forging apparatus 100 after extrusion of the original billet 150 has taken place. Accordingly, the original billet 150 has been deformed into the forged part 155, at least a part of which corresponds to the shaped portion 132 of the die piece 130. In FIG. 2, the upper press 110 is shown as being provided with a shaped portion 112 (which may be in the form of an upper die piece), and the shape of the forged part 155 also corresponds at least in part to the shape of the shaped portion 112 of the upper press 110.

After the forging has taken place by striking the billet 150 with the striking portion 142 in the direction of arrow A shown in FIG. 1, the grip load is released and the upper press 110 is moved away from the rest of the apparatus in the direction of arrow C, shown in FIG. 2. Due to the high energy involved in the extrusion process (which may lead to a degree of distortion of the punch 140 and/or the die piece 130 and/or the upper press 110 and/or lower press 120), the forged part 155 may on some occasions stick to the upper press 110 at the interface 160 as it is moved away in the direction of arrow C, and thus may be lifted away from the die piece 130. On other occasions, the forged part may remain in the die piece 130. It can be unpredictable whether or not the forged part 155 will remain in the die piece 130 on any given extrusion cycle. Where the forged part 155 is lifted up with the upper press 110, it may or may not stay attached to the upper press 110. On occasions where the forged part 155 is lifted up with the upper press 110 and then subsequently falls away (for example due to relative expansion/contraction resulting from temperature changes), the final position of the forged part may be entirely unpredictable.

If the forging apparatus 100 is being operated manually, then this unpredictability of the position of the forged part 155 after the forging process may result in an increase in overall process time as the operator has to locate the forged part 155, and in some cases remove it from the upper press 110 (which may not be straightforward), before transferring, it to the next step of the manufacturing process.

However, an even greater problem occurs where the forging process is automated and/or where it is part of an automated manufacturing process. For example, an automated process may require the use of a machine (such as a robot) to transfer the forged part 155 to another apparatus for further processing, such as machining and/or clipping. In order for this to be possible, it is necessary for each forged part 155 to be in the same position after every forging cycle, i.e. after the upper press 110 has been moved away from the lower press 120. If the position of the forged part 155 may be different for each forging cycle, as may occur with the conventional apparatus/Process described above, then the robot that is used to transfer the forged part 155 to the next step of the process will not be able to reliably locate the part 155, and the automated process would fail.

OBJECTS AND SUMMARY

At least some aspects of the present disclosure address at least some of the issues outlined above.

According to an aspect, there is provided an extrusion punch for striking a billet during a forging (which may be or include extrusion) operation. The extrusion punch comprises a striking surface arranged to strike the billet in use. The extrusion punch comprises a recess formed in the striking surface. The striking surface may be a planar surface. The recess may not strike the billet, at least on initial contact of the extrusion punch and the billet.

According to an aspect, there is provided a method of forging (which may be or may include extruding) a shaped component comprising positioning a billet in a lower press. The method comprises moving an upper press into engagement with the lower press so as to locate the billet between the upper press and the lower press. The method comprises striking the billet with a striking surface of an extrusion punch in a forging direction so as to force the billet into a cavity formed by the upper and lower presses, the cavity defining the shape of the shaped component. The method comprises moving the upper press and the lower press away from each other. According to the method, the extrusion punch comprises a recess formed in the striking surface. Material from the billet enters the recess as the billet is forced into the cavity, thereby locking the shaped component and the extrusion punch together.

The shaped component and the extrusion punch may remain locked together as the upper and lower presses are moved away from each other. If a suitable force is provided, the shaped component and the extrusion punch may be separated from each other when locked together. For example a separating force may be provided in a separation direction to separate the shaped component and extrusion punch. When locked together, the shaped component and the extrusion punch may be restrained from relative movement in one direction but relative movement may be permitted in another direction to allow separation.

Accordingly the recess in the extrusion punch may allow the shaped component and the extrusion punch to be locked together (or engaged, or interlocked) after extrusion. This may enable the position of the shaped component to be consistent after each forging process, for example by preventing the shaped component from being attached to the upper press as it is separated from the lower press. This may prevent wasted time during, mammal manufacturing operations and/or allow the forging to be automated, of to become part of an automated manufacturing process.

In operation, the upper and lower presses may be said to move relative to each other in a clamping direction, the clamping direction being perpendicular to the forging direction. The extrusion punch and shaped component may be locked together at the recess so as to restrain relative movement in the clamping direction more than in the forging direction. This may allow the extrusion punch and the shaped component to be more easily separated (for example by a robot) in the forging direction than in the clamping direction. The locking force in the clamping direction may be sufficient to ensure that the extrusion punch and the shaped component remain locked together when the upper and lower presses are separated.

The striking surface of the extrusion punch may surround, for example completely surround, the recess, for example when viewed in a direction that is perpendicular to the striking surface (which direction may be opposite to the forging direction).

The outer perimeter of the striking surface may be circular, for example. The outer perimeter of the recess may be circular, for example. Where both the outer perimeter of the striking surface and the outer perimeter of the recess are circular, the striking surface may be said to be an annular shape.

The recess may have any suitable size and/or shape, for example any suitable depth into the striking surface. For example, the recess may extend in the range of from 0.5 mm to 10 mm, for example 1 mm to 5 mm, for example 2 mm to 4 mm, for example 2.5 mm to 3 mm into the punch in a direction perpendicular to the striking surface.

According to an aspect, there is provided a forging apparatus for producing a shaped component from a billet. The forging apparatus comprises an upper press and a lower press. When moved together, the upper press and the lower press define a first cavity for receiving the billet and a second cavity defining, the shape of the shaped component, the first and second cavities being in communication with each other. The forging apparatus comprises an extrusion punch comprising a recess formed in a striking surface as described and/or claimed herein configured to strike the billet so as to force the billet from the first cavity to the second cavity.

It will be appreciated that the terms lower press and upper press as used herein may simply refer to first and second presses. As such, the terms first press and lower press may be interchangeable, and the terms second press and upper press may be interchangeable.

The second cavity of the forging apparatus may be referred to as a die, for example a closed die. The first cavity and the second cavity may be part of the same physical component, or formed by the same physical components, which may be referred to as die pieces. A part of the first cavity and a part of the second cavity may be formed by the lower press for one or more components attached to the lower press), and complimentary parts of the first and second cavities may be formed by the upper press for one or more components attached to the upper press). The upper press and/or the lower press may be said to comprise a respective die portions. Such die portions may at least in part define the shape of the first and/or second cavities. The shape of the die portion(s) may be changed in a given forging apparatus depending on the desired shape of the shaped component. It will be appreciated that where the terms upper press and lower press are used, these may be taken to include a respective die portion where present.

The first cavity and the second cavity of the forging apparatus may be offset from each other in a direction that is aligned with a forging direction. The striking force provided by the extrusion punch may be collinear with the offset from the first cavity to the second cavity.

The forging apparatus may comprise a ram configured to strike the extrusion punch. The ram and the punch may be separate from each other.

The method of forging the shaped component may comprise positioning the extrusion punch in the lower press before moving the upper press into engagement with the lower press; and striking the extrusion punch with a separate ram so as to cause the striking of the billet with the extrusion punch. Both the shaped component and the extrusion punch may remain locked together in the lower press as the upper and lower presses are moved away from each other.

Such a forging apparatus and/or method in which the extrusion punch and ram are separate may have still further improved reliability, for example improved tolerance to misalignment between the ram and the billet during forging.

In such an arrangement, the extrusion punch may comprise a first part (which may be referred to as a header portion) which, in use, is struck by the ram, and a second part (which may be referred to as an extrusion portion) which, in use, strikes the billet. The header portion and the extrusion portion may be integral parts of the extrusion punch.

The header portion has a cross sectional area perpendicular to the direction in which it is struck by the ram and the extrusion portion has a cross sectional area perpendicular to the direction in which it strikes the billet. The cross sectional area of the header portion may be greater than the cross sectional area of the extrusion portion.

The extrusion punch may comprise an impact portion. The ram may comprise a striking portion. The striking portion may be configured to strike the impact portion in use.

The upper and lower presses of the forging apparatus may be configured to be moveable relative to each other in a first direction (which may be referred to herein as a clamping direction). The extrusion punch may be configured to strike the billet in a second direction (which may be referred to herein as an extrusion direction) that is perpendicular to the first direction. In this way, the upper and lower presses may be configured to provide a clamping force to the billet that is perpendicular to and/or independent of the extrusion force provided by the extrusion punch.

A punch holder may be provided that is fixed relative to the lower press and engages the extrusion punch. Such a punch holder may be fixed relative to the lower press. The punch holder may restrain the extrusion punch from movement in the first direction (i.e. the clamping direction). The extrusion punch may be said to the fixed in position in the first direction and/or fixed relative to the lower press, for example by the punch holder. The punch holder may, for example, comprises suitable engagement portions that may engage with the extrusion punch (for example with corresponding engagement portions on the extrusion punch) to restrain the movement of the extrusion punch, for example to allow the extrusion punch to move in the extrusion direction but not in the clamping direction.

The centrelines of the first cavity and the punch holder (where present) of the forging apparatus may be aligned. In this regard, the centrelines may be co-linear with the longitudinal axes of the first cavity and punch holder, and thus also the longitudinal axes of the billet (when inserted into the first cavity) and the punch (when inserted into the punch holder).

The forging apparatus, forging method and/or extrusion punch may be used in the manufacture of any suitable shape, such as an aerofoil, which may be, for example, for a gas turbine engine. Thus, the second cavity of the forging apparatus may define an aerofoil shape (or any other desired shape). Further processing, such as finishing and/or machining, may be required before the final shape (for example a final aerofoil shape) is defined.

According to an aspect, there is provided a method of manufacturing a part comprising the method of forging a shaped component as described and/or claimed herein. The method further comprises using a robot to transfer the shaped component after the forging process from a predetermined post-forging position to a second location. The forging position may be the term used to describe the position of the shaped component once the first and second presses have been moved apart. Because this position is repeatable and reliable, a robot may be used to pick up and move the shaped component from the forging apparatus, for example from the lower press. A further manufacturing process such as machining and/or clipping and/or finishing and/or further forging) may subsequently be performed, for example at the second location and/or elsewhere.

According to an aspect, there is provided a shaped component and/or a part manufactured at least in part using the extrusion punch and/or forging apparatus and/or method as described above and elsewhere herein.

BRIEF DESCRIPTION OF THE DRAWINGS

For a better understanding of the present disclosure, reference will now be made, by way of non-limitative example only, to the accompanying drawings, in which.

DETAILED DESCRIPTION OF EMBODIMENTS

Figure 1:
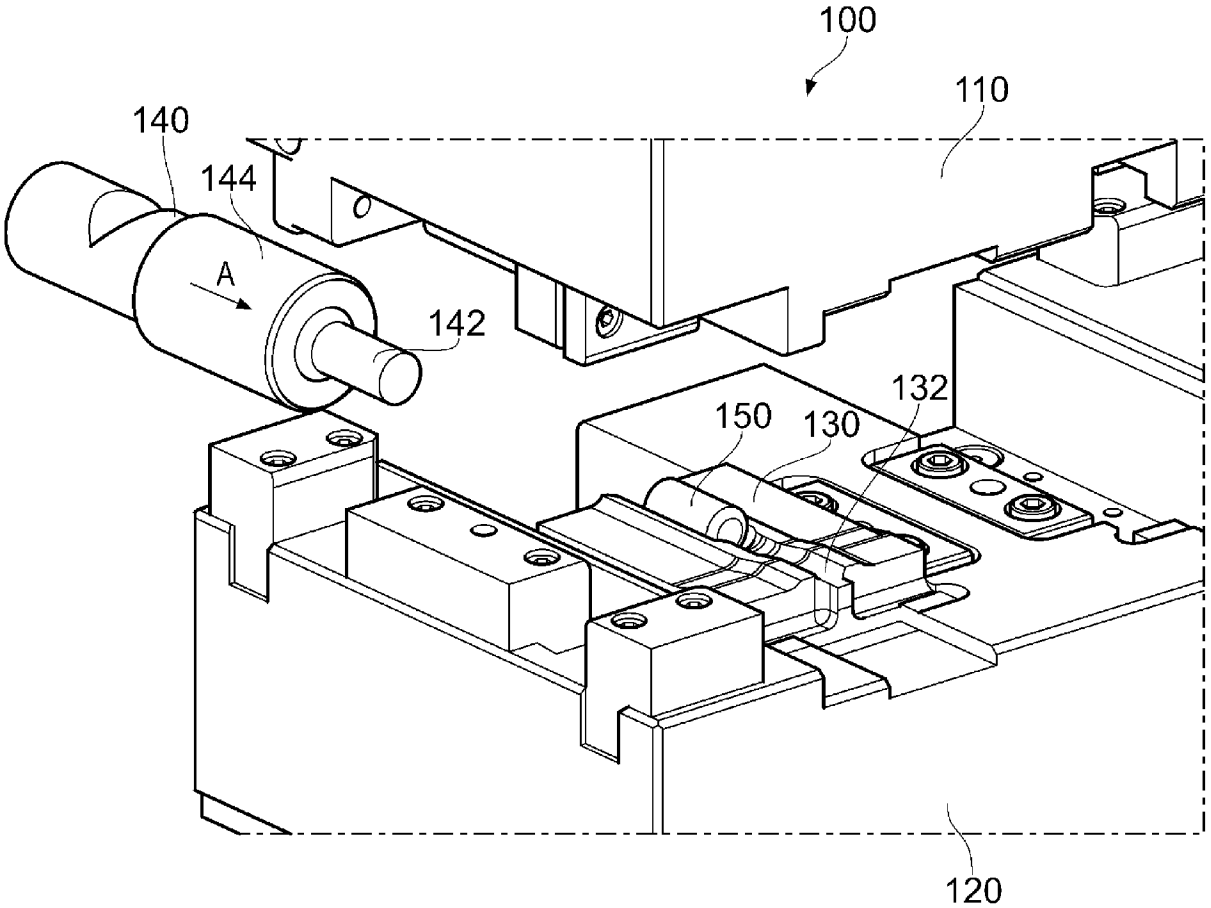
FIG. 1 PRIOR ART
FIG. 1 shows a perspective view of a forging apparatus.

The operation of an example of a forging apparatus 100 has been described above in relation to FIGS. 1 and 2. As explained above, a problem with the arrangement of FIGS. 1 and 2 is that on some occasions the forged component 155 may stick to the upper press 110 as it is moved away from the lower press 120, whereas on other occasions, the forged component 155 may remain in the lower press 120 (for example in the die piece 130 of the lower press 120).

Figure 3:
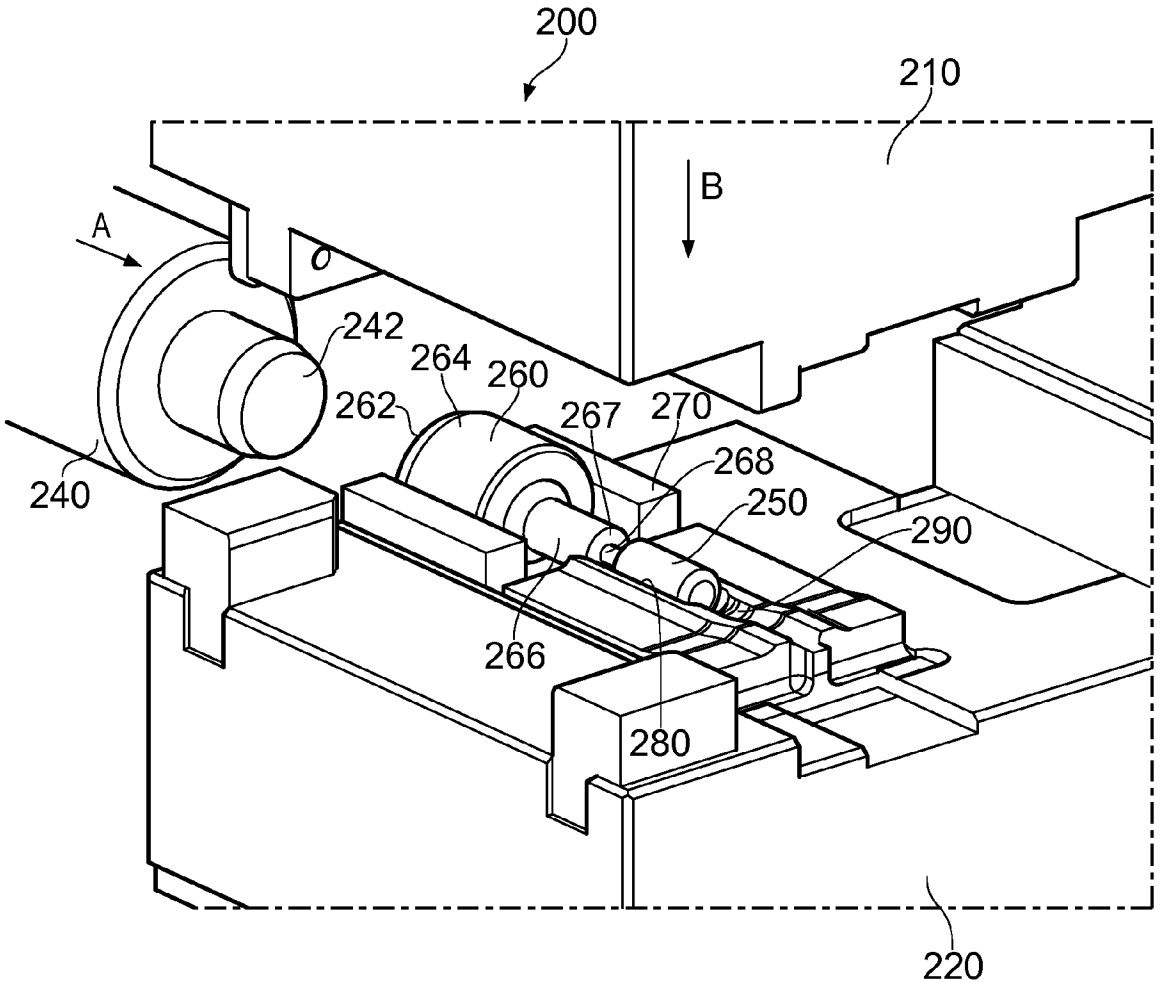
FIG. 3 shows a perspective view of part of a forging apparatus in accordance with an example of the present disclosure prior to extrusion of a billet.

FIG. 3 shows a schematic view of part of a forging apparatus 200 in accordance with an example of the present disclosure. The forging, apparatus 200 has an upper press 210 and a lower press 220. The upper press 210 and the lower press 220 are shown spaced apart, but during use they move together, such that the upper press 210 moves in the direction of arrow B (which may be referred to as the clamping direction) relative to the lower press 220, thereby receiving (which optionally, may include clamping and/or holding) a billet 250.

The forging apparatus 200 also comprises a ram 240 and a separate extrusion punch 260 (which may be referred to simply as a punch 260). The punch 260 is held in a punch holder 270, which may be defined by the lower press upper and/or lower presses 210, 220. In the FIG. 3 example, the punch holder 270 is defined by the lower press 220.

In operation, the ram 240 is propelled towards the punch 260 using a suitable motive force in the direction of arrow A, which may be referred to as the forging direction. As shown in the FIG. 3 example, the direction of arrow A may be perpendicular to the direction of arrow B. The direction of arrow A may be substantially horizontal, for example.

The ram 240 has a striking portion 242 that strikes an impact portion 262 (which may be part of a header portion 264) of the punch 260. This causes the punch 260 to be propelled in the forging direction A towards the billet 250. In turn, this causes the punch 260 (for example an extrusion portion 266 of the punch 260) to strike the billet 250, thereby forcing it from a first cavity 280 in which it is shown in FIG. 3, into a second cavity 290. The second cavity 290 may have the shape of the shaped component that is desired to be output from the forging apparatus 200. This may be any suitable shape, for example an aerofoil shape.

The first and second cavities 280, 290 may be offset from each other in the same direction as the forging direction A, as shown in the FIG. 3 example. Also as illustrated in FIG. 3, the first and/or second cavities may be formed by the upper and lower presses 210, 220, for example when the upper and lower presses 210, 220 are moved together. For example, the upper and lower presses 210, 220 may have respective die portions that conic together to formm the first and/or second cavities 280, 290. Such die portions may be integral parts of the upper and lower presses 210, 220, or may be removable/replaceable parts that are fixed to the respective upper and lower press 210, 220.

Figure 4:
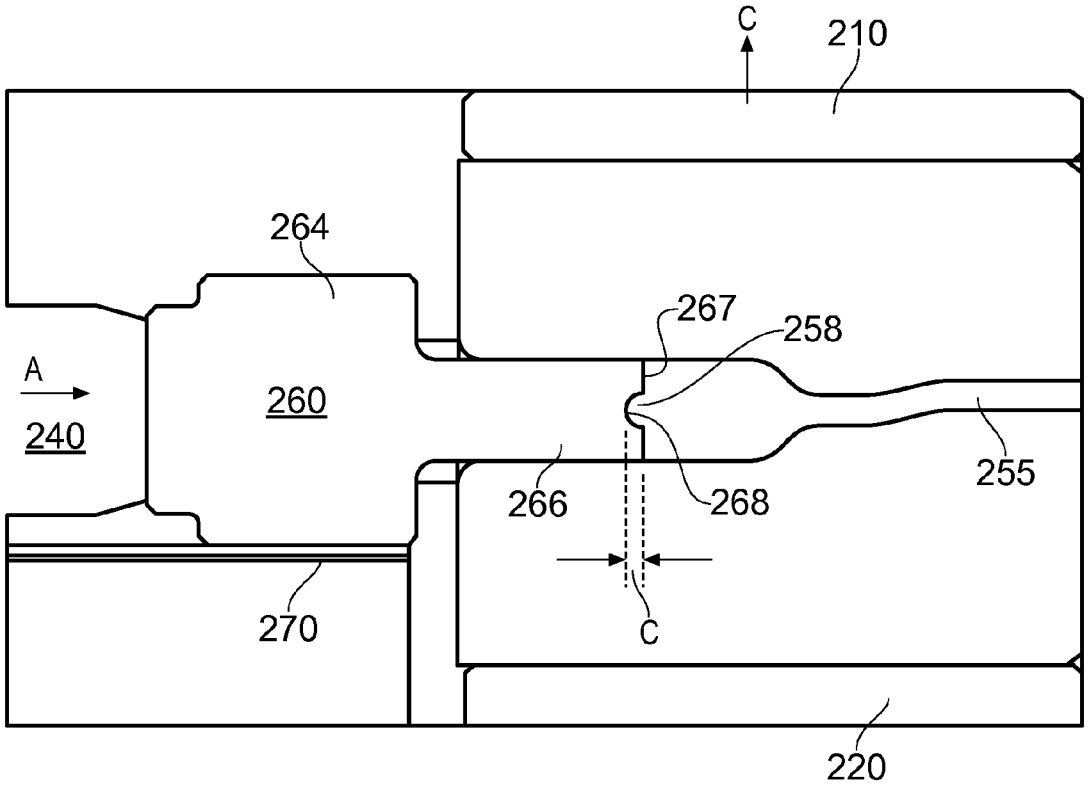
FIG. 4 shows a cross section through a part of a forging apparatus, including an extrusion punch in accordance with an example of the present disclosure, after an extrusion operation.

The extrusion punch 260 strikes the billet 250 with a striking surface (or striking face) 267. As shown in FIG. 4, the extrusion punch 260 has a recess 268 (which may be referred to as a dimple 268, for example) which is formed in the striking surface 267. The recess 268 may be said to extend from the striking surface along an extrusion axis, for example in the opposite direction to the forging direction A shown in FIGS. 3 and 4. The recess 268 may be said to extend into the extrusion punch 260 from the striking surface 267.

The recess may take any suitable shape, for example it may form a hemisphere (or other part/fraction of a sphere) in (that is, extending into) the striking surface 267. The radius of a sphere forming such a hemisphere or other fraction of a sphere may depend on the component 255 being extruded, for example the size and/or shape of the shaped component 255. By way of example, the radius may be in the range of from 0.5 mm to 10 mm, for example 1 mm to 5 mm, for example 2 mm to 4 mm, for example 2.5 mm to 3 mm where the shaped component 255 is, for example, an aerofoil component (such as a compressor or turbine blade or vane) of a gas turbine engine.

Regardless of the shape of the recess 268, the recess 268 may extend into the extrusion punch 260 from the striking surface 267 to a depth (or distance) shown by the letter in the FIG. 4 example. The depth 1 may be any desired depth, which may depend on the component 255 being extruded, for example the size and/or shape of the shaped component 255. By way of example, the depth 1 may be in the range of from 0.5 mm to 10 mm, for example 1 mm to 5 mm, for example 2 mm to 4 mm, for example 2.5 mm to 3 mm where the shaped component 255 is, for example, an aerofoil component (such as a compressor or turbine blade or vane) of a gas turbine engine.

The example of FIGS. 3 and 4 has just one recess 268 formed in the striking surface 267, but it will be appreciated that the extrusion punch 260 may comprise any number of recesses 268, for example one, two, three, four, five, or more than five recesses 268.

During the forging process (for example during extrusion of the billet 250 to form a shaped component 255), material from the billet (or workpiece) 250 penetrates (for example flows, extrudes or is forced) into the recess 268. The recess 268 may be said to be a void in the extrusion punch 268 into which material from the billet 250 may flow (or fill) during extrusion/forging. As shown by way of example in FIG. 4, this means that the shaped component 255 formed by the extrusion process has an extension 258, which may be referred to as a pip 258, that corresponds in shape to the recess 268 of the punch 260. The pip 258 may be said to be keyed into the recess 268 after extrusion. The shaped component 255 and the punch 260 may be held together (or locked together, or engaged) after the extrusion by the pip 258 of the shaped component interlocking (or engaging) the recess 268 in the punch 260.

After extrusion, the upper and lower presses 210, 220 are moved apart, for example by moving the upper press 210 in the direction of arrow C shown in FIG. 4, which may simply be the opposite direction to the clamping direction B shown in FIG. 3. The directions shown by both arrows B and C may be referred to as the clamping direction, with clamping, being effected by movement of the upper press 210 relative to the lower press 220 in the direction B, and clamping being released by movement in the opposite direction shown by arrow C. Because of the interlocking of the pip 258 and the recess 268, the punch 260 and the shaped part 255 remain locked together even when the upper press 210 and lower press 220 are moved apart. For example, the punch 260 and the shaped part 255 may remain in the lower press 220 (or a die associated with the lower press 220). Accordingly, the position of the shaped part 255 can be reliably and/or accurately known after completion of the extrusion and forging process, for example after the upper and lower presses 210, 220 have been separated. This may allow the shaped part to be located and optionally moved (either by a machine, such as a robot, or by a human) for further processing, which may include removal of the pip 258 and/or other machining/finishing.

As mentioned elsewhere herein, the punch 260 may be held in the forging apparatus 200, for example in the lower press 220, by a punch holder 270. The punch holder 270 may be integral with another part of the forging apparatus (such as the lower press 220) or may be provided as a separate part. The punch holder 270 may restrain (or prevent) the punch 260 from moving in a certain direction, for example in the direction C shown in FIG. 4 in which the upper press 210 is separated from the lower press 220 after the shaped part 255 has been extruded. Because of the engaging pip 258 and recess 268, this may help to ensure that the shaped part 255 is not lifted up with the upper press 210 during separation of the presses 210, 220. However, it will be appreciated that such a punch holder 270 that restrains movement of the punch 260 in the direction C may not be required, and may not be present in all embodiments. For example, the weight of the punch 260 may be sufficient to prevent it (and thus the shaped part 255) from being lifted out of the lower press 220 when the upper and lower presses 210, 220 are separated.

In the example shown in FIGS. 3 and 4, the extrusion punch 260 and the billet 250 are both placed and held between the upper press 210 and the lower press 220 during forging. This means that their relative position, or at least the relative position of their longitudinal axes, is defined by the same piece of apparatus (i.e. the presses 210, 220), and thus cannot vary between forging operations. This arrangement ensures that the punch 260 always strikes the billet 250 in the same direction and at the same position. As such, regardless of any variability in alignment of the punch 260 and the ram 240 (and thus of the billet 250 and the ram 240) no unknown or variable force or bending moment is passed into the punch 260, and so it is not susceptible to breakage.

This means that even if the precise position of upper and lower presses 210, 220 varies slightly between forging operations and/or over time, for example due to the extremely high loads involved, the punch 260, and thus the portion 266 of the punch 260 that strikes the billet 250, is always axially aligned with the billet 250. Thus, even if the ram 240 strikes the punch 260 along a skewed or offset path, the punch 260 still provides a forging (or extrusion) force to the billet 250 that is aligned with the billet 250, for example collinear with the longitudinal axis of the billet 250.

This arrangement in which the ram 240 and the extrusion punch 260 are separate may help to prevent damage to the components of the forging apparatus 200 because no unknown or unwanted force or bending moment is passed through the interface between the relatively narrow extrusion portion 266 of the punch 260 and the rest of the punch 260. Any unwanted force or bending moment that results from an unwanted offset of the ram 240, punch 260 and billet 250 passes through the much bulkier and stronger parts of the ram 240 and punch 260 which are not subject to the same dimensional constraints, and thus can be engineered to resist such unwanted forces/bending moments.

However, whilst the example of FIGS. 3 and 4 is shown as having a separate ram 240 and extrusion punch 260, it will be appreciated that other examples in accordance with the invention may have a combined ram and punch. For example, the billet 250 may be directly struck by an extrusion punch that is propelled by a motive force (for example an external motive force) towards the billet 250 in the extrusion direction A to form the shaped component 255.

Figure 2:
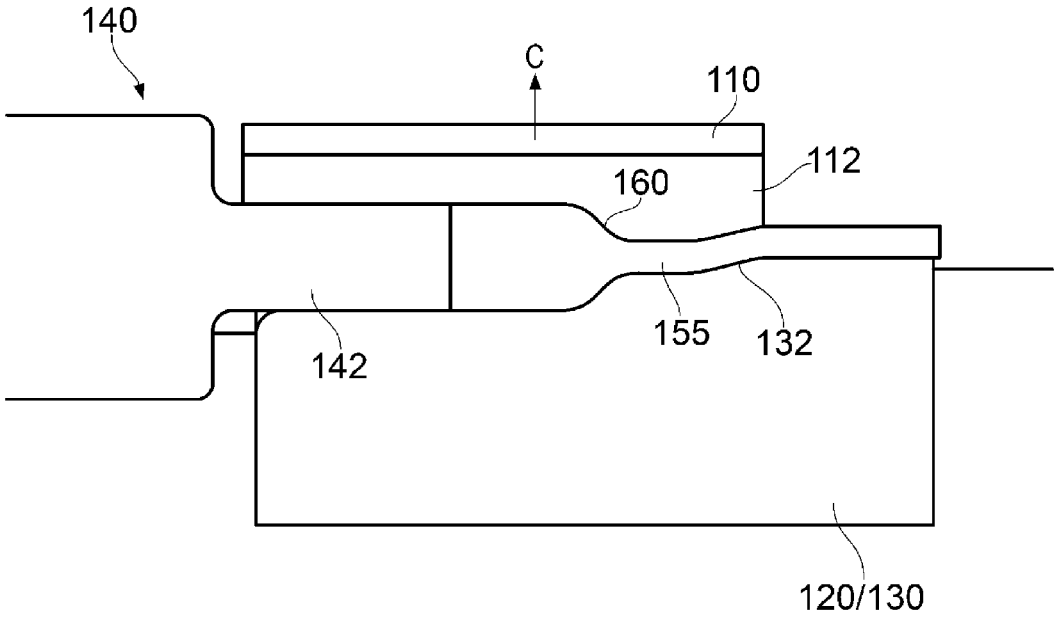
FIG. 2 PRIOR ART
FIG. 2 shows a cross sectional view through a forging apparatus after extrusion of a part.

Such an extrusion punch may, for example, be substantially as described in relation to FIGS. 1 and 2, but may be provided with a striking surface 267 and recess 268, for example as described above in relation to FIGS. 3 and 4. As such, an extrusion punch according to the invention may itself be propelled towards the billet 250 in use (as in FIGS. 1 and 2, for example), or a separate ram 240 may be provided to strike the extrusion punch (as in FIGS. 3 and 4, for example).

It will be appreciated that the forging apparatus 200 described and claimed herein may be a part of a larger apparatus and/or process. For example, the shaped component 255 generated after the billet 250 has been forged by being forced into the second cavity (or die) 290 may required further processing, such as finishing and/or further shaping in order to become a finished part. By way of further example, the billet 250 may be heated before being transferred to the first cavity 280. The various processes may be automated, including the transportation of the billet 250 and/or shaped components between the various processes.

Any component and/or feature described herein may be combined with any other compatible component and/or feature. Furthermore, it will be appreciated that various alternative and/or complimentary arrangements and/or components not explicitly described herein are in accordance with the invention.

I claim:

1. A method of forging a shaped component comprising:

positioning a billet in a lower press;

moving an upper press into engagement with the lower press so as to locate the billet between the upper press and the lower press;

striking the billet with a striking surface of an extension punch in a forging direction so as to force the billet into a cavity formed by the upper and lower presses, the cavity defining the shape of the shaped component; and moving the upper press and the lower press away from each other, wherein:

the extrusion punch comprises a recess formed in the striking surface into which material from the billet enters as the billet is forced into the cavity, thereby locking the shaped component and the extrusion punch together such that both the shaped component and the extrusion punch remain locked together in the lower press as the upper and lower presses are moved away from each other.

2. A method of forging a shaped component according to claim 1, further comprising:

positioning the extrusion punch in the lower press before moving the upper press into engagement with the lower press; and striking the extrusion punch with a separate ram so as to cause the striking of the billet with the extrusion punch.

3. A method of forging a shaped component according to claim 1, wherein:

the upper and lower presses move relative to each other in a clamping direction, the clamping direction being perpendicular to the forging direction; and the extrusion punch and shaped component are locked together at the recess so as to restrain relative movement in the clamping direction more than in the forging direction.

* * * * *